US006536699B2

(12) United States Patent
Glass

(10) Patent No.: US 6,536,699 B2
(45) **Date of Patent: *Mar. 25, 2003**

(54) MEDICAL AND POWER CORD CONTROL AND STORAGE APPARATUS

(76) Inventor: Bruce A. Glass, 74 Eastwood Dr., Deerfield, IL (US) 60015

( * ) Notice: Subject to any disclaimer, the term of this patent is extended or adjusted under 35 U.S.C. 154(b) by 53 days.

This patent is subject to a terminal disclaimer.

(21) Appl. No.: 09/795,896

(22) Filed: Feb. 28, 2001

(65) Prior Publication Data

US 2001/0007298 A1 Jul. 12, 2001

Related U.S. Application Data

(63) Continuation-in-part of application No. 09/444,135, filed on Nov. 20, 1999, now Pat. No. 6,206,318, which is a continuation-in-part of application No. 09/190,909, filed on Nov. 12, 1998, now Pat. No. 5,992,788, which is a continuation-in-part of application No. 08/888,032, filed on Jul. 3, 1997, now Pat. No. 5,836,537.

(51) Int. Cl.[7] ..... B65H 75/44
(52) U.S. Cl. ..... 242/400.1
(58) Field of Search ..... 242/129, 398, 242/400, 400.1, 406, 407

(56) References Cited

U.S. PATENT DOCUMENTS

| | | | |
|---|---|---|---|
| 2,037,668 | A | 4/1936 | Smith |
| 2,427,801 | A | 9/1947 | McKee |
| 2,438,143 | A | 3/1948 | Brown |
| 2,573,636 | A | 10/1951 | Wilson |
| 2,693,001 | A | 11/1954 | Vance |
| 3,021,087 | A | 2/1962 | Rudolph |
| 3,027,115 | A | 3/1962 | Allen |
| 3,075,723 | A | 1/1963 | Wohlfeil |
| 3,111,753 | A | 11/1963 | Seibold |
| 3,395,308 | A | 7/1968 | Meyer |
| 3,752,148 | A | 8/1973 | Schmalzbach |
| 4,062,430 | A | 12/1977 | Momberg |
| 4,101,089 | A | 7/1978 | Culbertson |
| 4,498,693 | A | 2/1985 | Schindele |
| 4,720,768 | A | 1/1988 | Schindele |
| 4,724,844 | A | 2/1988 | Rafelson |
| 4,809,393 | A | 3/1989 | Goodrich |
| 5,255,767 | A | 10/1993 | Norwood |
| 5,513,643 | A | 5/1996 | Suite |
| 5,513,816 | A | 5/1996 | Grubb |
| 5,588,444 | A | 12/1996 | Petragallo |
| 5,727,745 | A | 3/1998 | Vara |
| 5,836,537 | A | 11/1998 | Glass |

*Primary Examiner*—William A. Rivera

(57) ABSTRACT

The invention provides an apparatus for conveniently storing and retrieving cords associated with electronic devices or other power devices. The apparatus comprises a rectangular plate having opposed top and bottom edges and opposed left and right edges. In one embodiment, for each of the cords a pair of spaced-apart, opposed hooks is mounted on the plate near opposed edges, with each of the hooks comprising a stem having a first end in contact with the plate and a second, opposite end. An arm extends perpendicularly outwardly from the stem second end facing away from the other hook of its pair so cords can be wrapped around the pair. In one embodiment, a surge suppressor is associated with the cord control system. In another embodiment, the plate is made of a polymer material and the posts are molded into the plate. In another embodiment, the plate comprises grooves along the top and bottom edges, and the posts rotate in the grooves. In another embodiment, the hooks are mounted on strips, which are located on a central rib.

17 Claims, 14 Drawing Sheets

42
46
38
44
26
40
27
28
38
40
42

10
26
11d
52
60
42
38
54
56
38
38
30
27
11b
38
38
11a
38
38
11c 26
28
10
27
11d
38
38
38
40
11a
30
38
38
38
11b
42
11c
38
38
38

142
144
27
26
11a 126
124
122
36
118
140
114
120
D1
116
138
134
136
132
D2
128
130
146
144

MEDICAL AND POWER CORD CONTROL AND STORAGE APPARATUS

This is a continuation-in-part of patent application Ser. No. 09/444,135 filed on Nov. 20, 1999 now U.S. Pat. No. 6,206,318, which is a continuation-in-part of patent application Ser. No. 09/190,909 filed on Nov. 12, 1998, now U.S. Pat. No. 5,992,788, which is a continuation-in-part of Ser. No. 08/888,032 filed Jul. 3, 1997, now U.S. Pat. No. 5,836,537, all which are incorporated by reference herein.

BACKGROUND OF THE INVENTION

This invention relates to a medical cord management apparatus, and more particularly to medical monitor lead management for the multitude of wires or cords emanating from medical monitors. The purpose of the cord management apparatus is to provide an organized, tangle free, easily accessible storage system for the multitude of monitor leads, tubes, wires and hoses required at various times for medical monitoring purposes.

Medical facilities particularly monitored acute care areas such as ICU, emergency and recovery, have undergone an explosion in monitoring technology. In the past a patient may have had one or two monitor leads attached. Now it is not uncommon for there to be at least four and as many as eight or nine leads attached to a patient. Sensors attached to these leads monitor several functions such as skin temperature, ECG/respiration rate, non-invasive blood pressure, internal blood pressure, oxygen saturation and CO2 levels.

This invention also relates to an apparatus for management and storage of power cords and wires in and around office desks, workstations, stereo systems, entertainment centers, video games and industrial or laboratory workbenches. In many of these locations multiple cords are needed for carrying electrical power between a central device and peripheral devices such as printers, keyboards, speakers, CD players and various instruments. These cords must be managed in a manner to allow easy access in time of need, but stored neatly while the devices are being used in their normal manner.

A problem has arisen in management of these wires when they are not in use and are left attached and dangling from the monitor or central device in an unkempt tangled mess generally referred to as the "Spaghetti Syndrome". In the medical environment, removing or disengaging the cords from the monitor when not in use has not proven to be a feasible method for storage and management for a number of reasons, not the least of which is that the sensor attached to the cord is not immediately available in an emergency situation.

In addition, cords stored in a drawer become tangled and lost and are not immediately identifiable. If the cords are left dangling from the monitor, the medical room achieves an unkempt, unprofessional appearance, and again, the cords are unavailable for immediate use because individual cords are indistinguishable. Also, cords left dangling and tangled from the back of a computer, stereo, power tool or laboratory instrument create an unsightly mess and often times create a tripping hazard or fire hazard. In many situations, cords drop from a central processor, such as a computer or monitor, lay along the floor near a wall and raise back up to the remote, peripheral unit. Besides being unsightly, this creates a problem of cleaning the floor when the cords are in the way. A cord holding management and storage apparatus is needed to keep the cords off the floor, but not catch dirt or dust that could fall along the wall.

Medical room rail or headwall systems having basic storage means are known. For example, in U.S. Pat. No. 4,498,693, a rail system for the wall of a medical room is shown. The rail system has a mounting clamp carrying a hanger arm so that medical equipment may be positioned, retained and/or stored thereon. The arm is a simple, cantilever extension of the rail reminiscent of a shelf bracket.

U.S. Pat. No. 4,720,768 also discloses an electrical medical rail system. This system also discloses a dressing tray attached thereto and depending therefrom.

The dressing tray is a simple box structure with a substantially open front side.

Accordingly, there has arisen a need for an efficient and easily used system or apparatus for temporarily storing and managing the numerous cords associated with medical monitoring. There is also a need for an equally efficient system or apparatus for temporarily storing and managing the numerous cords associated with computers, stereos, entertainment centers, video games and industrial and laboratory workbenches. There is also a need for an apparatus for keeping cords off the floor along the junction between a wall and floor when a cord is used to attach a remote peripheral device with a central device, or for a power cord plugged into a wall electrical outlet and running to an electrical device. There is also a need for producing a cord control and storage apparatus in a cost effective and efficient manner.

SUMMARY OF THE INVENTION

A cord storage apparatus comprises a plate having opposed top and bottom sides and opposed right and left sides, and means for attaching the plate to a stationary location on or near an electronic device. The cord storage system also comprises at least one pair of opposed hooks, with one of the pair adjacent the top or left side and the other adjacent the bottom or right side. Each of the hooks includes a stem having a proximal end contacting the plate and an opposite distal end, and an arm extending at a right angle to the stem at the distal end. Each of the arms of the pair of hooks faces away from the other of the pair so a cord can be wound about the opposed pair of hooks.

In one embodiment of the cord storage apparatus, at least one of the hooks also has a longitudinal center line, a means for allowing the stem and arm to rotate about the center line, and a means for locking the at least one hook in a position in which the one hook is pointed away from the other of the pair of hooks. The means for locking the arm and the means for allowing the stem and arm to rotate comprises at least one protrusion extending outwardly from the proximal end of the stem, at least one indentation on the surface of the plate, means for urging the protrusion into the indentation when the protrusion is registered with the indentation and means for limiting the travel of the stem in the longitudinal direction if the stem is pulled away from the plate and rotated.

In another embodiment of the cord storage apparatus, the means for locking the arm and the means for allowing the stem to rotate further comprises a hollow post having a first end, a second end and a length, with the post being internally threaded. The first end of the post is secured to the plate. The underside of the head of a threaded screw contacts the second end of the post when the screw is secure. The stem has a first internal bore extending inwardly from the proximal end with a length shorter than the length of the post, a second internal bore extending inwardly from the distal end having a larger diameter than the first internal bore, and a shoulder between the first and second bores. A wave spring is located between the screw head and the shoulder for urging the stem toward the plate.

In a further embodiment of the cord storage apparatus, the plate has a first front side and a second backside and the hooks are mounted on the first side and the attaching means is mounted on the second side of the plate.

In another embodiment, the cord storage apparatus further comprises a Velcro brand hook and loop strip attached to the backside for storing peripheral items also having a complementary Velcro brand strip.

The invention also provides a new and novel apparatus for storing the wires or cords associated with computer, stereos, telephones, entertainment centers, video games, industrial or laboratory workbenches or the like. The apparatus comprises a plate having opposed top and bottom or left and right sides. For each of the wires or cords, a pair of spaced-apart, opposed hooks is mounted on the plate adjacent the top and bottom or left and right edges. Each of the hooks comprises a stem having a first end in contact with the plate, a second, opposite end and a longitudinal axis. An arm extends perpendicularly outwardly from the stem second end and away from the other of the pair of hooks. Accordingly, each of the wires or cords can be wrapped around the pair of hooks for storage, and the wire or cord can be removed from storage by unwrapping it from its pair of hooks.

In a further embodiment, the cord storage system is used to control and store input power cords or peripheral device leads that usually lay on the floor. The apparatus comprises an elongate flat narrow plate having opposed top and bottom edges and a means for attaching the plate to a wall of a room somewhere slightly above the floor. The apparatus also has at least three upwardly facing hooks located adjacent the bottom edge of the plate, with the hooks being spaced apart a distance that is sufficiently close to keep the hooks from drooping onto the floor. In one embodiment, the distance is approximately 7.25 inches.

In a further preferred embodiment, the plate can be bent into an L shape at or near its bottom to accommodate an electrical surge suppressor that is commonly known in the art. The surge suppressor can either be incorporated into the plate, or it can be a separate item and installed into the trough or ledge created by bending of the plate. Other embodiments of an integrated cord storage system and surge suppressor are also contemplated; such as the surge suppressor being installed in the center of the plate or at either end, or it being mounted flush or extending outward from the plate. In a further alternative, the surge suppressor can be mounted on the backside of the plate, or on a separate mounting bracket associated with the plate.

In another embodiment, rather than being planar, the plate can have portions of the posts molded into the plate. In this embodiment, the hooks may snap on to the molded posts so that no assembly tools are required to manufacture the cord storage and management system. The plate may also have a reinforcing ridge around the outer periphery of the plate. The center of the plate may also have an aperture. The aperture may have a shape that complements the shape of indentations in the side walls, so that if multiple plates are attached side-by-side, a pair of indentations will resemble an aperture.

In another embodiment, the plate may have a reinforcing grid on the inside and grooves near the periphery to accommodate specially designed posts.

In a further embodiment, the opposite pairs of hooks are mounted on individual thin elongate strips of generally planar material. Near the outer edges of the thin strips of material are grooves that will hold the pairs of hooks to a central separating rib member to keep the individual strips of planar material and pairs of hooks laterally spaced.

It is an object of the invention to provide an apparatus for temporarily or permanently storing cords in a manner in which they can be easily stored and retrieved by the operator of the device attached to the cord.

It is the further object of the invention to reduce the clutter and increase the safety associated with computers, telephones, stereos, entertainment centers, video games and laboratory or industrial workbenches by allowing the operators to easily store associated cords on a planer board on hooks, and easily remove the cords from storage.

BRIEF DESCRIPTION OF THE DRAWINGS

FIG. 17 is a cross section of a plate for a seventh embodiment of the invention.

The invention, together with further aspects, objects, features and advantages thereof will be more clearly understood from the following description taken in conjunction with the accompanying drawings in which the elements bear the same reference numerals throughout the various views.

DESCRIPTION OF THE PREFERRED EMBODIMENTS

Figure 2:
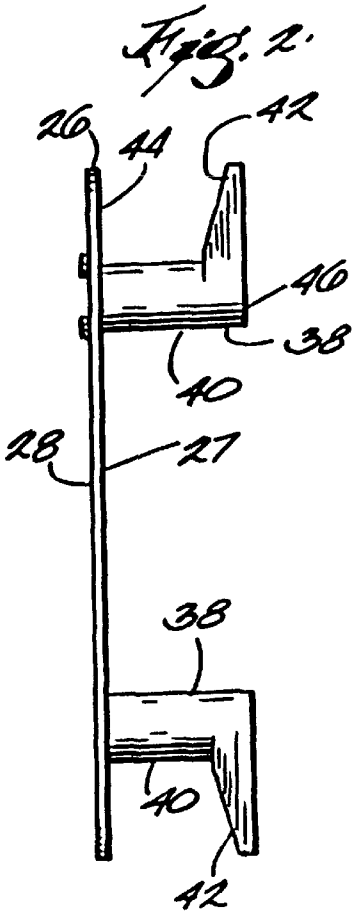
FIG. 2 is a left side elevational view of the invention.
Figure 1:
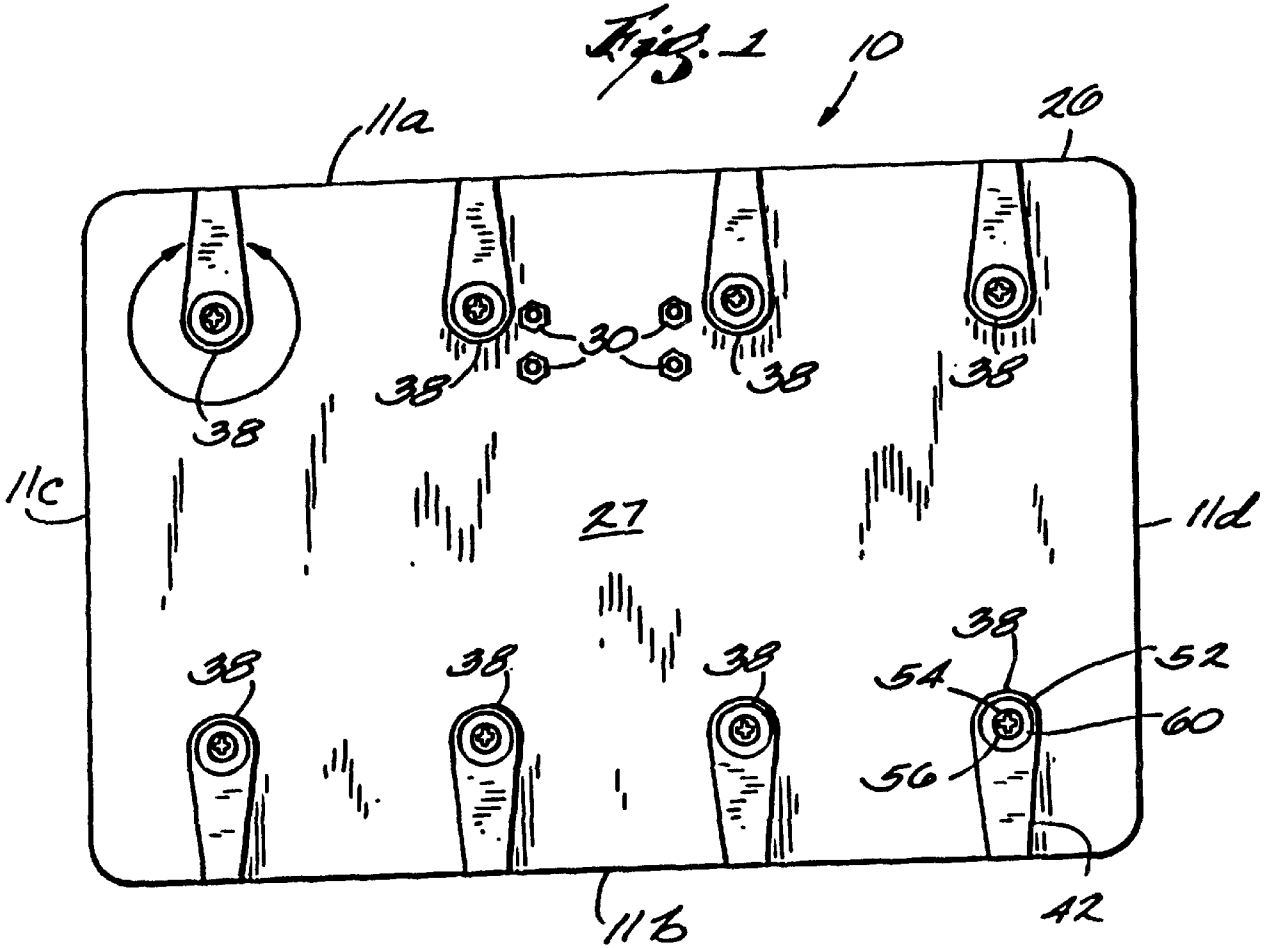
FIG. 1 is a front elevational view of the invention.
Figure 3:
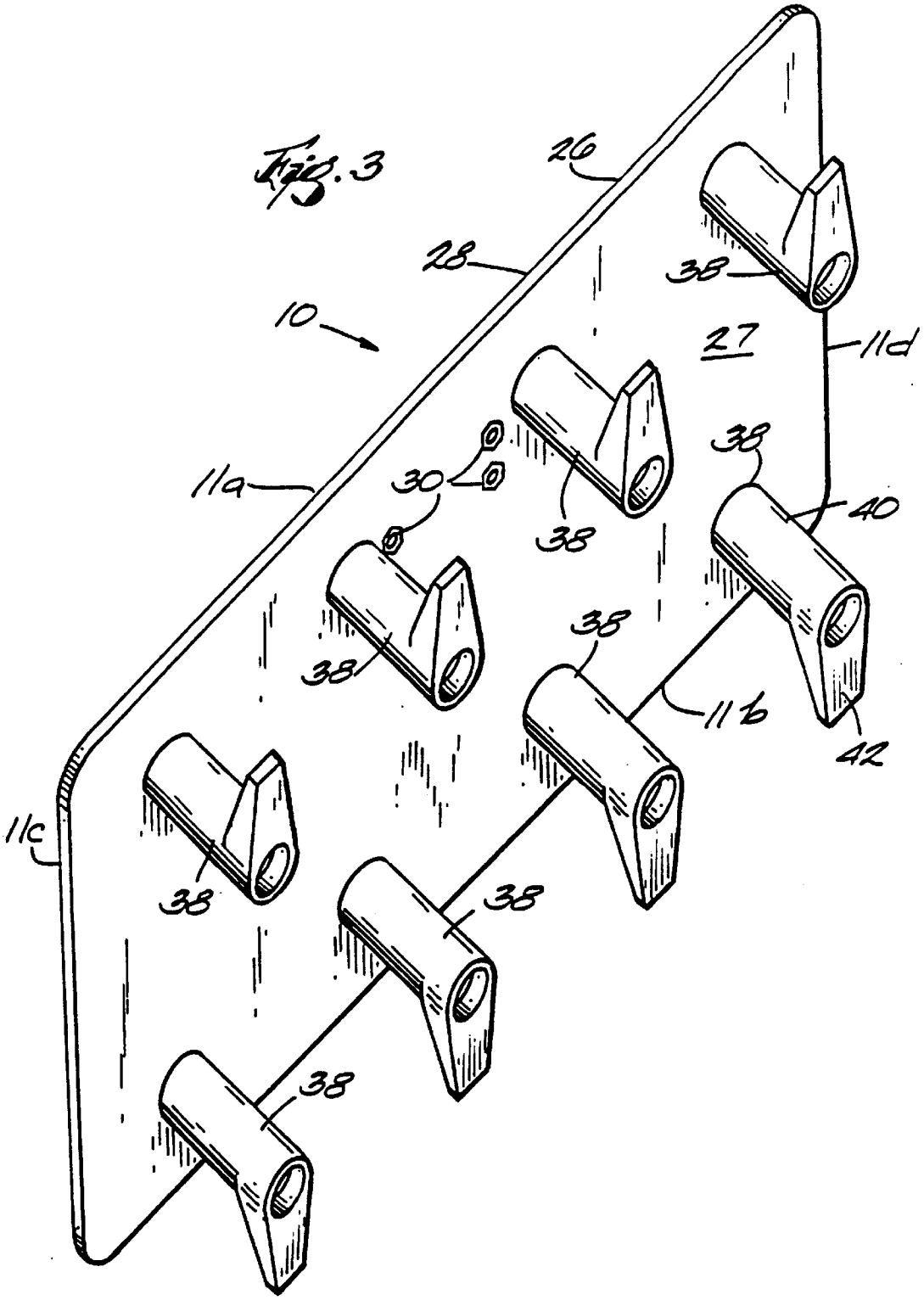
FIG. 3 is a perspective view of the invention.
Figure 4:
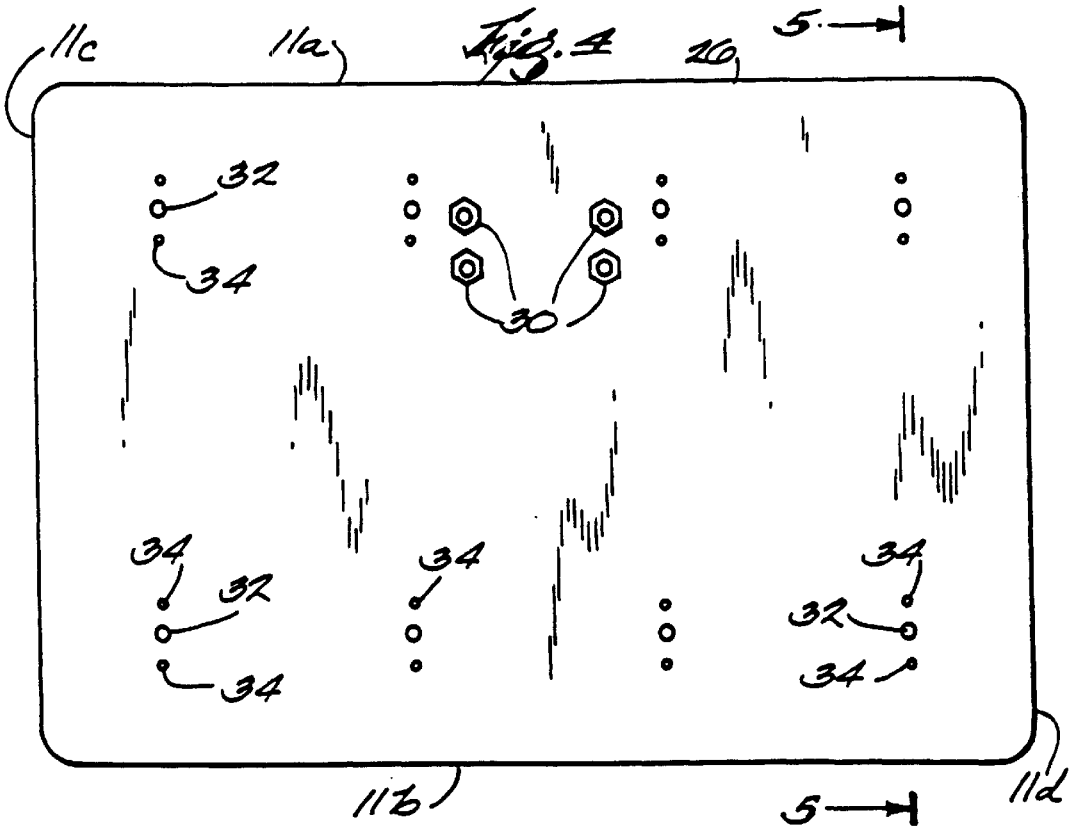
FIG. 4 is a front elevational view of the invention at one stage of manufacture.
Figure 6:
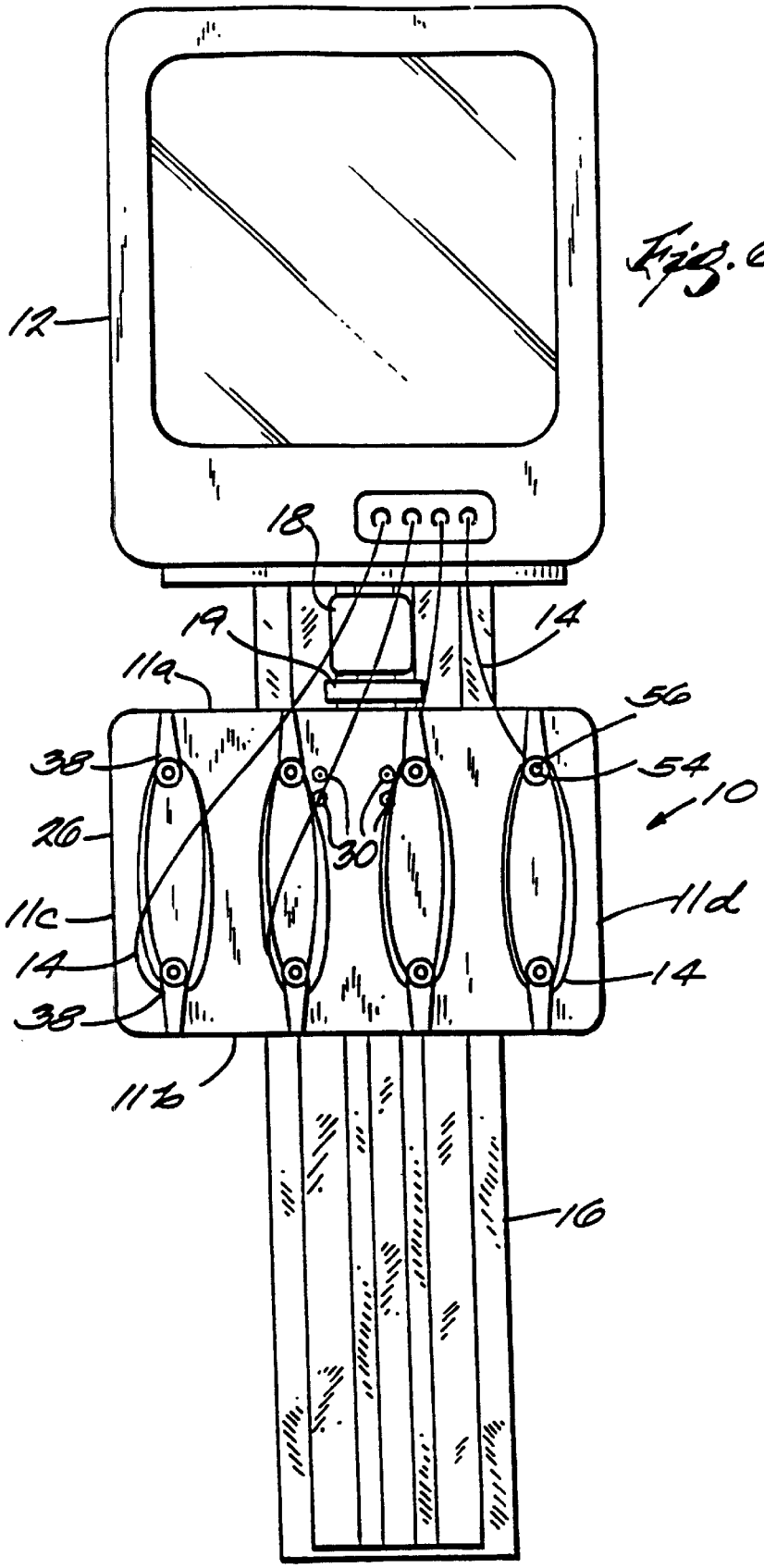
FIG. 6 is a front elevational view of the medical cord control and storage apparatus mounted below a medical monitor.

Referring generally to FIGS. 1, 3 and 6, a means or apparatus 10 is provided for efficiently and effectively managing, controlling and storing multiple medical monitor cords or leads. As explained earlier, for each patient in a medical or hospital room, a medical monitor 12 is associated. The monitor 12 provides visual and sometimes audible displays of various bodily functions such as skin temperature, ECG/respiration rate, non-invasive blood pressure, internal blood pressure, oxygen saturation and CO2 levels. Generally, pick-ups or sensors for each of these functions has its own separate cord or lead 14.

As used herein, the words leads and cords are interchangeable and can comprise tubes, wires or hoses. Leads or cords 14 generally run from an information gathering sensor associated with a body function to an information display such as a monitor. Other cords or leads 14 may also be present in a medical room, such as those for providing power to various instruments and providing necessary gases, such as oxygen, medical air and vacuum (suction).

As used herein, leads or cords 14 can also be found in and around office desks and workstations, especially those associated with computers, such as power cords, interconnection cords or wires for computer peripherals, monitor cords, printer cords and speaker cords. Leads or cords 14 are also found used with telephones and fax machines and with stereo system speaker wires, patch cords and power cords. Leads or cords are also found with video games, with television connections, power cords, controller cords and control boxes and in other similar areas. Power cords are very commonly found plugged into a wall outlet, drooping down to and laying on a floor near a wall junction and plugged into an electrical device.

Leads or cords 14 are also found in and around industrial or laboratory workbenches in connections for power tools, hand tools, microscope cords and powered lab instruments. Leads or cords 14 are also used with portable hospital equipment, especially equipment that does not have provisions for power cords, such as I.V. lines, infusion pump stands and examination lights.

Figure 7:
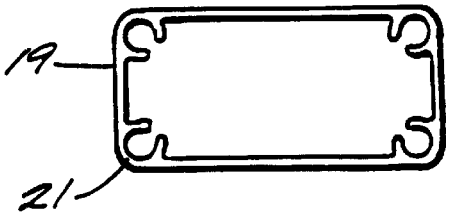
FIG. 7 is a cross sectional view of a mounting bracket for the medical cord control and storage apparatus.

In the medical environment, the monitors 12 are generally mounted to the walls of medical rooms by means of a commercially available monitor mounting channel 16, for example those made by GCX Corporation of Petaluma, Calif. The channel can either be mounted to a wall or mounted to a modular prefabricated headwall or rail system such as those shown in U.S. Pat. Nos. 4,498,693 and 4,720,768. The monitor 12 extends in front of the channel 16 by means of a bracket 18, such as a bracket also made by GCX Corp. The cord storage or control system 10 can then be hung from the bracket 18 by a bent aluminum bar or bracket 19 or it can be engaged into the channel 16 by means of a bracket 19. The plate 26 can be vertically oriented immediately below the monitor as shown in FIG. 6. However, the plate can be rotated into various orientations in order to make its use easier by the attending medical staff. Known brackets can accommodate these various orientations. One bracket shape that has been found to be effective is shown in FIG. 7. The four generally circular channels 21 at the corners of the inside of the aluminum extrusion of the bracket can, accept self-tapping screws. Alternatively, the cord storage means 10 may be mounted directly to the wall of the medical or hospital room.

When used in an office environment in and around office desks and workstations, the cord management apparatus 10 can be used to manage and organize computer power and connection cords. The control system 10 can be mounted to the backside of a desk, on a wall or divider, especially near the bottom, just above the floor, or on the back or side of a computer, monitor or the like in a manner similar to that used in the medical location or in other ways known in the art such as being screwed directly onto the wall or held on by Velcro brand hooks and loops. The same is true for use in conjunction with stereo or other systems or with video games or televisions. The cords 14 can be organized and managed so they stay off the floor, so as to enhance the aesthetics of the environment and reduce the potential tripping hazard. The cord management system 10 can be mounted to computer or television by means of hook and loop fastening devices, double-stick tape, mechanical fasteners such as screws or clamp-on mounting brackets. The cord management system 10 is also important when used on or around a laboratory or industry workbench in order to reduce clutter and tripping hazards, as well as make the laboratory technician more efficient. The cord management system 10 can be attached to the side or back of the workbench by hook and loop fastening devices, double-stick tape, mechanical fasteners such as screws or clamp-on mounting brackets.

Medical service personnel can also be more efficient when using I.V. lines, infusion pumps and exam lights if a cord control apparatus is connected to the device. For example, a cord control apparatus can be attached to an infusion pump stand to hold the power cord or to hold up excess length of I.V. tubing as it is moved from room to room in a hospital while transporting patients dependent on this equipment.

The cord storage or control system 10 generally comprises a plate 26, or other flat structural sheet for mounting multiple sets of pairs of opposed hooks 38, or a row of at least three hooks in a row all facing one direction.

In a preferred embodiment, the plate 26 is rectangular, approximately twelve inches by ten inches. Each pair of opposed hooks 38 is approximately five inches apart so that approximately ten turns of cord are wound on each pair of hooks of a typical ten foot long cord or lead. The plate has opposed top 11*a* and bottom 11*b* edges and opposed left 11*c* and right 11*d* edges, with the opposed pairs of hooks 38 adjacent opposed edges.

In a preferred embodiment, the plate 26 is made of aluminum and is approximately 3/32 (0.093) inches thick. The plate comprises a first front side 27 and a second backside 28. The plate comprises four centrally located apertures 30 for attaching the mounting bracket 19 to the second side 28 of the plate 26. In a preferred embodiment, the mounting bracket 19 is attached to the second side 28 of the plate by four self tapping screws passing through the four apertures 30 located to be in registry with the recesses 21. The multiple pairs of hooks 38 are attached to the first side 27 of the plate.

In some embodiments, both opposed hooks of each pair are permanently affixed to face away from the other of the pair. In other embodiments, one of the pair can rotate and for each opposed hook 38, the plate has an aperture 32. Immediately beside the aperture 32 is at least one indentation, recess or dimple 34. The dimple 34 comprises an indentation on the front of the plate. In a preferred embodiment, each aperture 32 has two dimples 34 associated with it. In this embodiment, the center lines of each of the pair of opposed apertures associated with the opposed hooks and each of the four associated dimples are all collinear. Although the preferred embodiment is a dimple shape, it can be appreciated that any type of camming surface will be effective for this purpose.

In a preferred embodiment, permanently installed, as by for example welding or brazing, in each aperture is a hollow, cylindrical post 36. Alternatively, a prefabricated, internally threaded, self-clinching flush stand-off such as those made by Penn Engineering and Mfg. Corp. of Danboro, Pa. can be used. Each post 36 has a radially extending lip 35 (see FIG. 5) at its first end 37 which is attached to the plate 26 on its second, or backside 28. The post 36 extends perpendicularly outwardly from the plate first side 27 for a length L to terminate in a distal or second end 39. In a preferred embodiment, each post has an interior thread throughout its length.

Positioned over each post and rotatable thereon is a hook member 38. Each hook member is preferably made of a rigid plastic material such as 10% glass filled nylon and comprises a stem 40 and an arm 42. The stem has a proximal end 44 which, in use, contacts the first side 27 of the plate 26 and a distal end 46. Protruding radially at a right angle from the stem longitudinal axis at its distal end is an arm 42.

Figure 5:
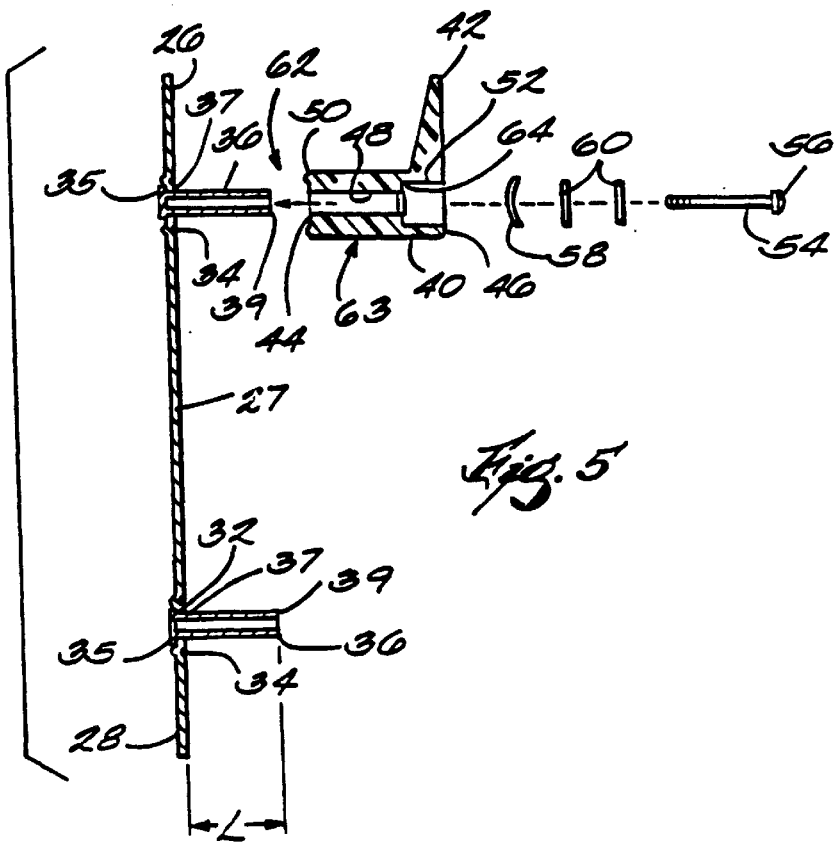
FIG. 5 is an exploded cross sectional view along line 5—5 of FIG. 4.

As shown in FIG. 5, the hook member 38 also comprises a first interior bore 48, which has an inner diameter which is slightly larger than the outer diameter of the post 36 and extends inwardly from the proximal end 44. In one embodiment, also at the proximal end 44 of the stem 40, is a pair of outwardly extending protrusions 50 which, in one orientation are in registry with and fit within the dimples 34. The length of the first inner bore 48, plus the length of the protrusions 50 is slightly less than the length L which the post 36 extends outwardly from the first side 27 of plate 26. Again, the protrusions 50 and dimples 34 can be any complementary camming shape.

The hook member stem 40 further comprises a second inner bore 52 extending inwardly from the distal end 46. The second inner bore 52 has an inner diameter which is larger than the outer diameter of the head 56 of the screw 54. At the intersection of the two bores is a shoulder 64.

In a preferred embodiment, each hook assembly also comprises a wave washer 58 and at least one flat washer 60 associated with the screw 54 and head 56. The wave washer 58 and flat washer 60 have an inner diameter which is larger than the shank of the screw and an outer diameter which is slightly smaller than the inner diameter of the second bore 52.

In the embodiment in which at least one hook rotates, the cord storage system comprises a means 62 for locking the stem at a certain orientation and a means 63 for allowing rotation of the stem about the post. In a preferred construction, the screw 54 is screwed into the threaded interior bore of the post 36. The head of the screw contacts the free or distal end 37 of the post 36. The one side of the wave washer 58 contacts the shoulder 64 between the first bore 48 and the second bore 52. The other side of the wave washer contacts the washer 60 which in turn contacts the underside of the head of the screw. Accordingly, the shoulder 64 is urged away from the head 56 of the screw 54 and the bottom side or proximal end 44 of the hook member 38 is urged against the first side of the plate 26. In one axial orientation, with the arm extending away from the other of the pair of apertures, the protrusions 50 extend into the dimples 34 to act as a means 62 for locking the hook in this predetermined orientation.

In operation, the means 63 for allowing rotation acts as follows. The hook can be grasped and pulled outwardly from the plate. The hook will only move the distance of the collapsibility of the wave washer, but this is sufficient for the protrusions 50 to extend out of the dimples 34. The hook member 38 can then be rotated about its longitudinal axis and the arm 42 can be pointed toward the other of the opposed pair of hooks. When the arm is pointed toward the other of the pair of hooks, the cords or leads 14 can be easily slid off the backside of the stem and removed for use. When the arm 42 is pointed away from the other of the pair of hooks, the cords or leads 14 can be wound around and onto the opposed pair of hooks for storage.

It can be appreciated that either of the opposed pair of hooks 38 can include the means for locking and the means for allowing rotation, or both could, depending on the preference of the attending staff. It can be further appreciated that it is only important for the arm 42 to rotate, not the stem 40. Accordingly, in another embodiment, the stem 40 may be fixed to the plate and have an outer end having a complementary camming surface with a rotating arm.

In one embodiment, on the second or backside 28 of the plate, can be permanently attached a Velcro brand hook and loop strip. This can be especially useful for attaching a blood pressure monitor cuff which has a complementary Velcro brand hook and loop strip also attached thereon.

Figure 8:
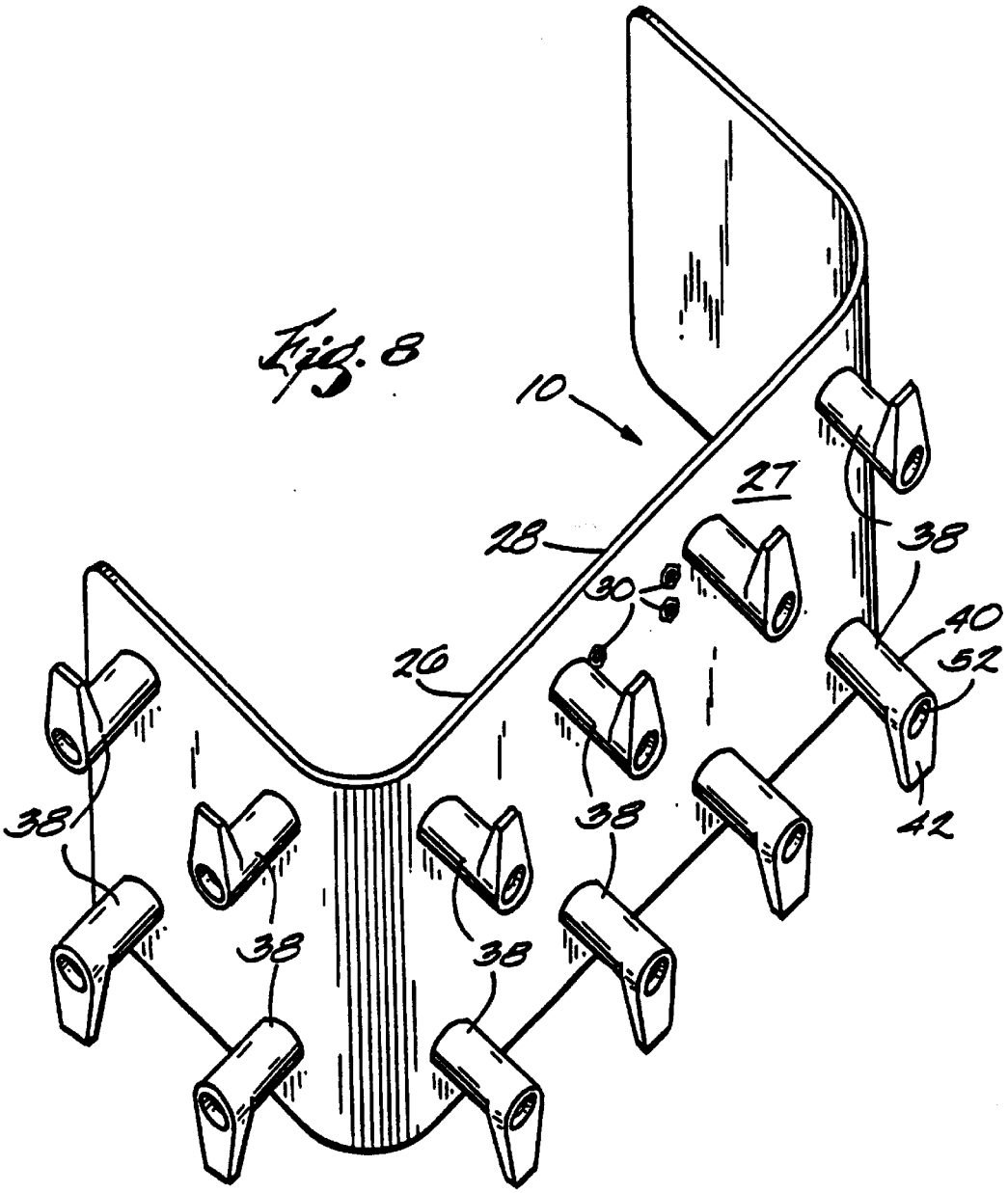
FIG. 8 is a perspective view of a second embodiment of the invention.

In other embodiments, the plate can have multiple pieces or be other than planer. For example, FIG. 8 shows a plate 26 that is bent at right angles at either end, so as to be able to accommodate additional pairs of hooks and have them located at a convenient location for the attending staff.

The preferred embodiment will be expandable in nature such that additional plates with hooks can be added on. Such additional plates will attach onto the preferred embodiment in most instances at a 90-degree angle on either or both sides duly increasing the storage capacity available.

Figure 9:
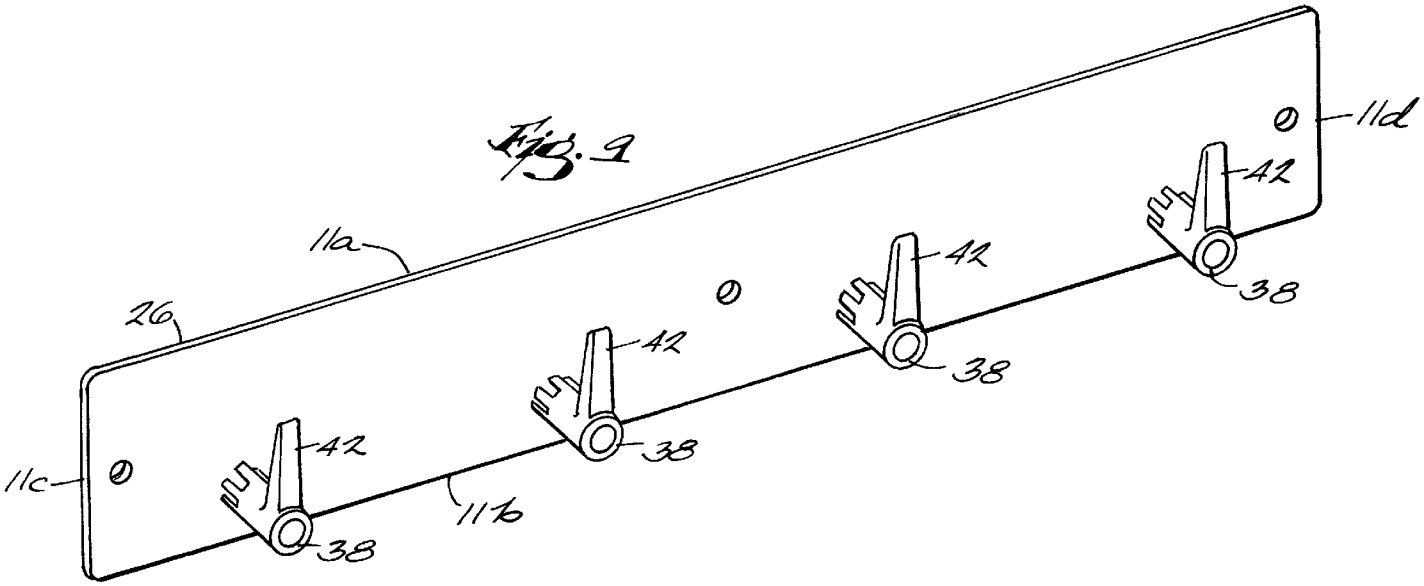
FIG. 9 is a perspective view of a third embodiment of the invention.
Figure 10:
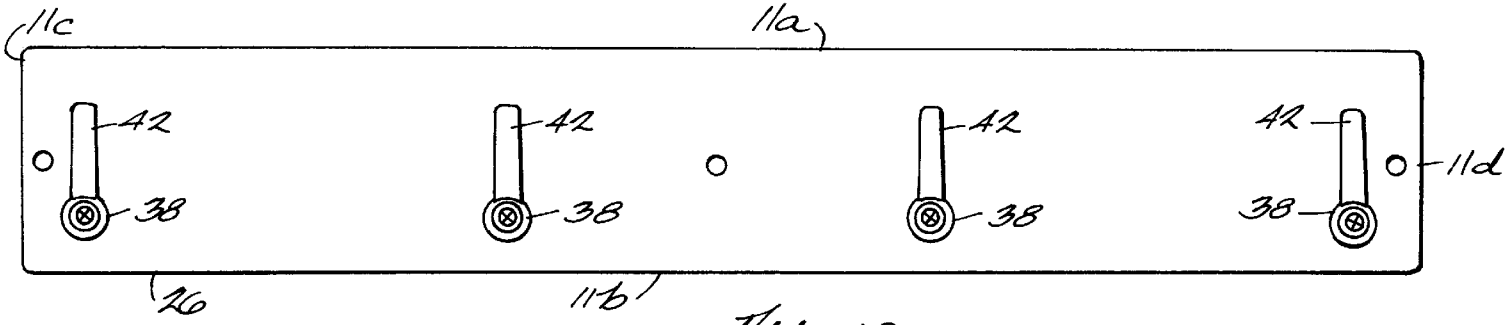
FIG. 10 is a front elevational view of the third embodiment of the invention.

A third preferred embodiment of the invention is shown in FIGS. 9 and 10. In this embodiment, the plate 26 is generally longer and narrower than in the other embodiments. Mounted on the plate are at least three hooks, 38, all oriented in the same upward direction. The plate has top 11*a*, bottom 11*b* edges and opposed left 11*c* and right 11*d* edges. The hooks are mounted on the plate proximate the bottom edge 11*b* with the arms extending upwardly toward the upper edge 11*a*. In one embodiment, the tip of the arm 42 ends proximate the upper edge 11*a*. In other embodiments, the tip of the arm 42 may extend above or below the upper edge 11*a*.

In use, the cord storage apparatus shown in the third embodiment will be mounted on the wall of the room in which the medical devices, laboratory equipment or electronic devices are located. The cord storage apparatus is preferably mounted near the bottom of the wall, but above the floor. Power cords, peripheral device control cords or other cords 14 used in the room are draped into the cord storage apparatus 10 and cradled by the hooks 38. The hooks are spaced sufficiently close to each other that the natural droop of the cords does not allow them to touch the floor. In a preferred embodiment, the hooks are approximately 7.25 inches apart, with four of them mounted on a plate 26 approximately 24 inches long and four inches tall.

In this way, the cords are maintained off the floor which not only creates an aesthetically pleasing appearance, but also provides for a more healthy environment since the floor can be cleaned right up to the junction of the wall. Moreover, since there is no solid trough, dust and dirt that might find itself on the wall is able to drop through the cord storage apparatus and onto the floor to be cleaned up. The apparatus may be mounted on the wall by screws, adhesive, double stick tape or by Velcro brand hook and loop fasteners. In one embodiment, the apparatus may be mounted by the Velcro fasteners directly on a vertical carpet wall molding.

Figure 11:
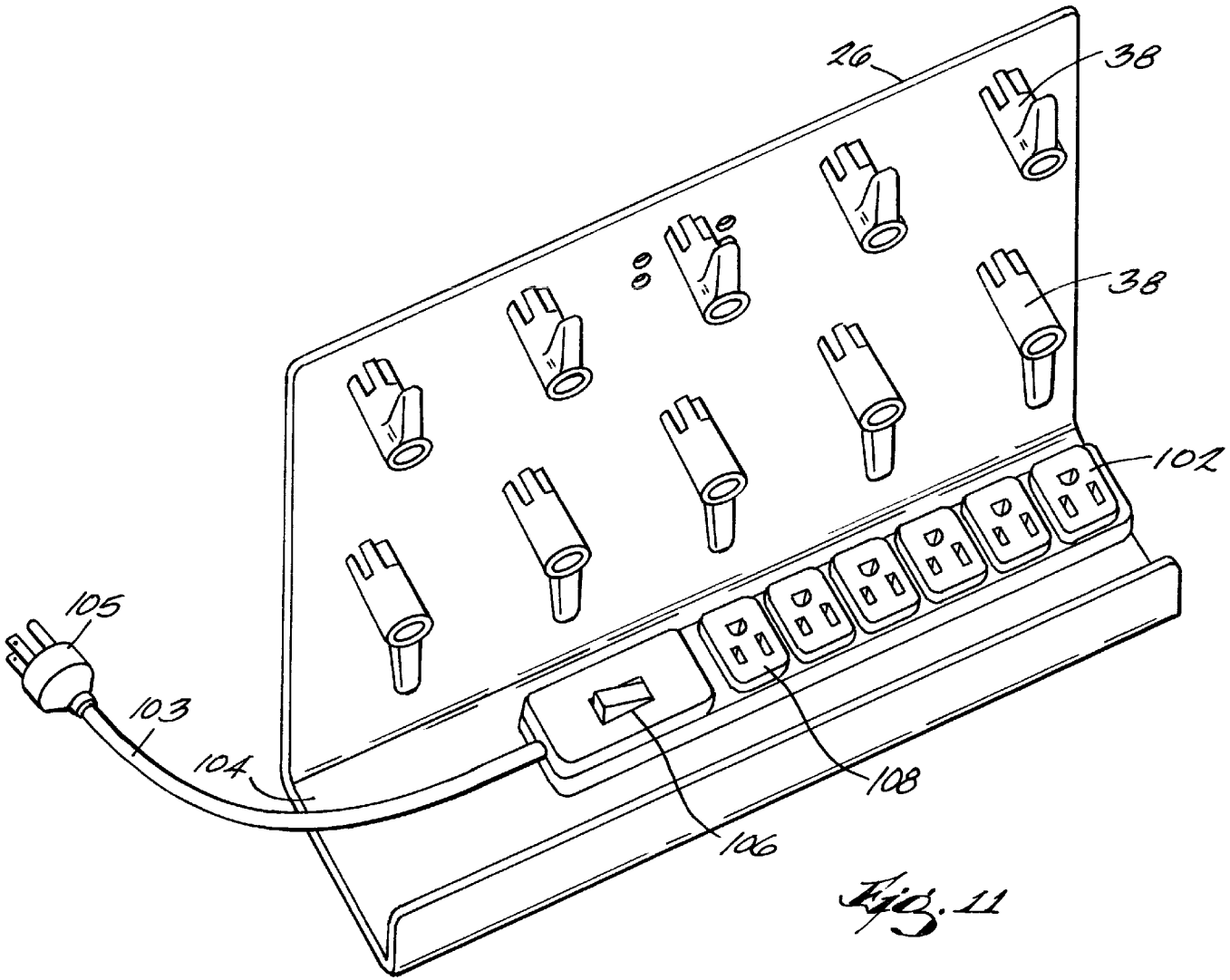
FIG. 11 is a perspective view of a fourth embodiment of the invention.
Figure 11:
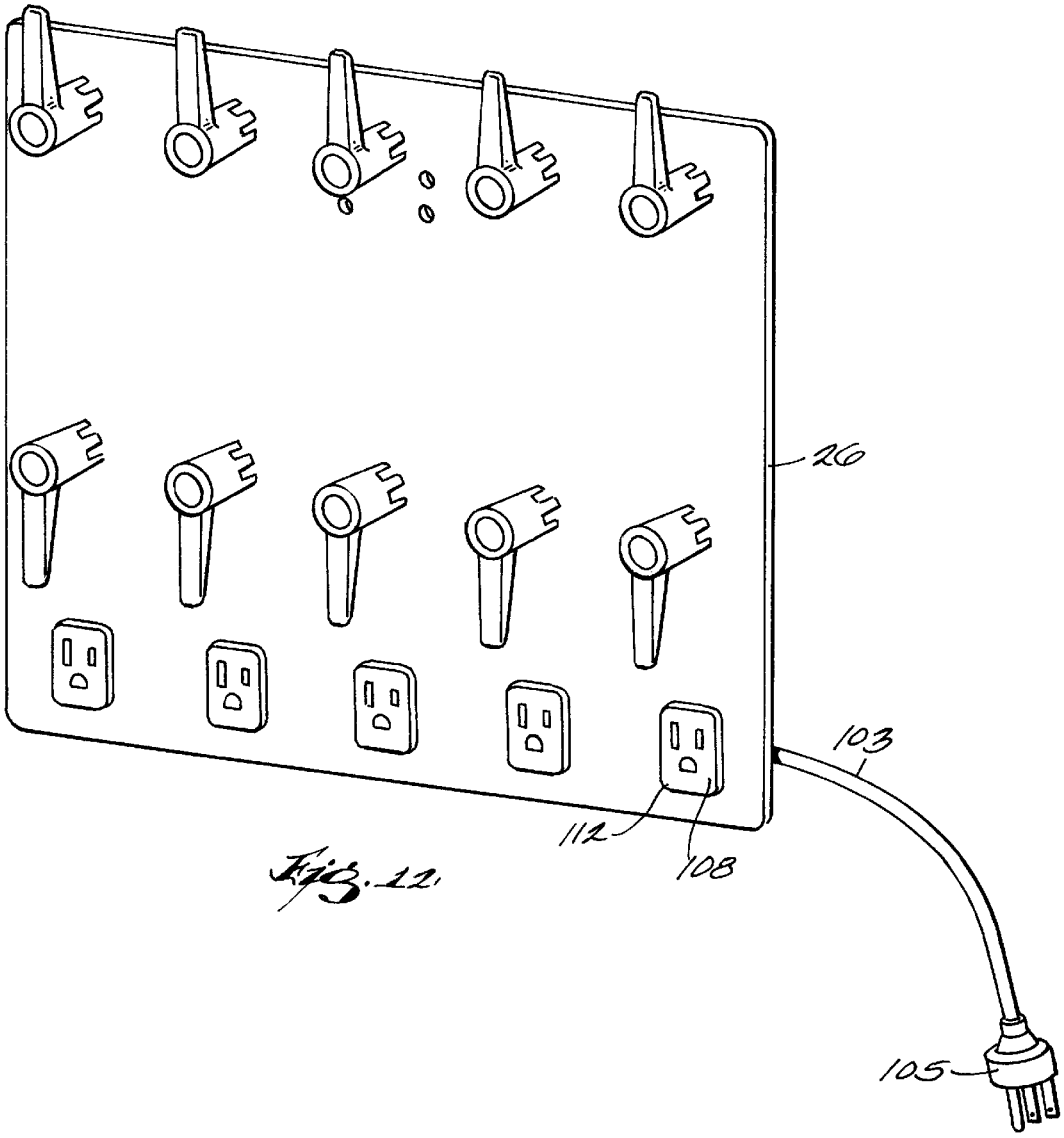

In a fourth preferred embodiment, as shown in FIG. 11, the plate 26 is bent at its bottom edge into an L shape to form a ledge or trough 104 to accommodate an electrical switch or electronic apparatus, such as a surge suppressor 102. The surge suppressor 102 can have a cord 103 with a plug 105, a switch 106 and multiple electrical outlets 108. In a preferred embodiment, there is one electrical outlet for each opposed pair of hooks 38. The plate includes a mounting apparatus or retaining device as with the other embodiments. The surge suppressor 102 may either be affixed to the plate 26 or merely laid on the ledge or trough 104.

Figure 13:
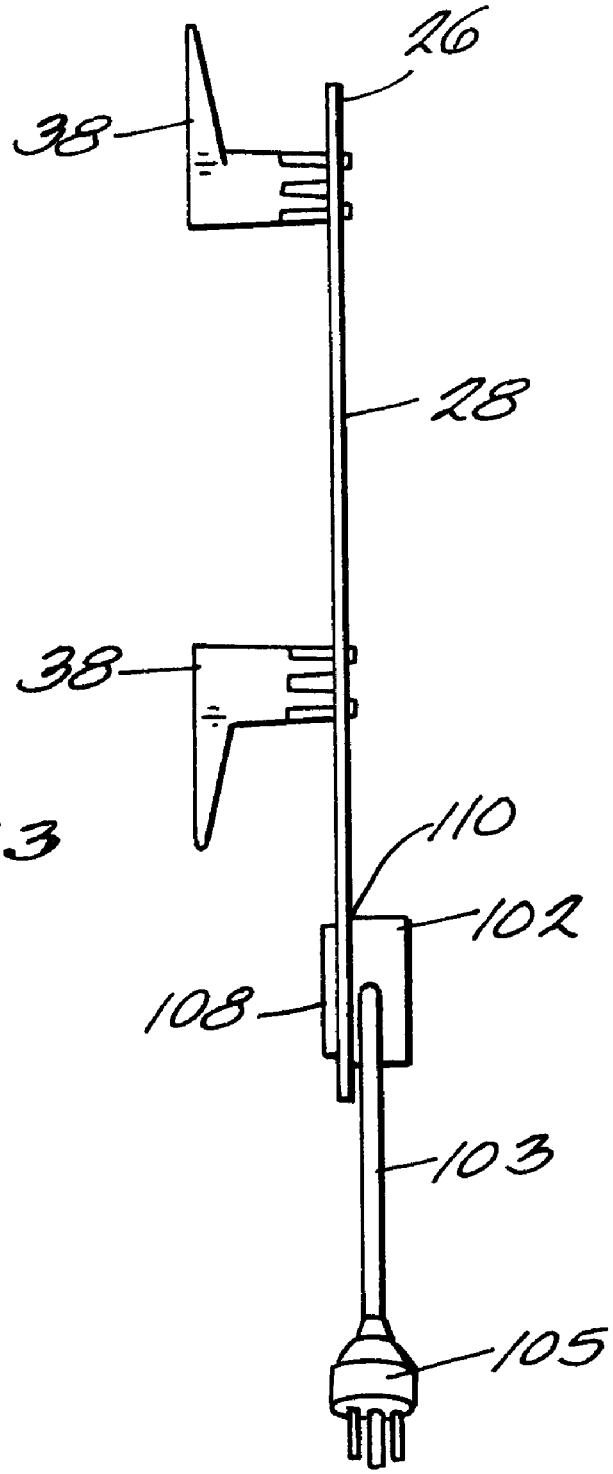
FIG. 13 is a side view of the fifth embodiment of the invention.
Figure 12:
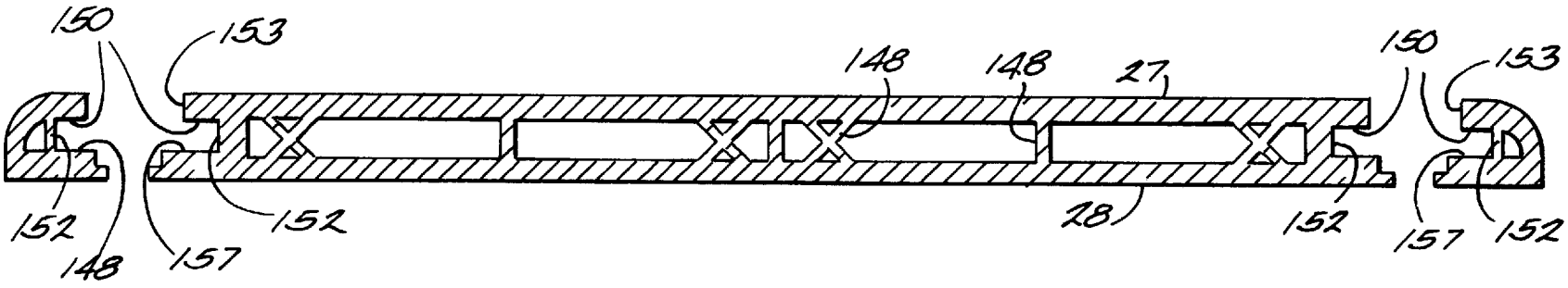
FIG. 12 is a perspective view of a fifth embodiment of the invention.

In a fifth embodiment, as shown in FIGS. 12 and 13, the electrical switching apparatus 102 (generally a surge suppressor) may be mounted directly to the plate 26. In a preferred embodiment, the front or top face 110 of the surge suppressor 102 is mated with the back side 28 of the plate 26. Each outlet 108 extends through an aperture 112 in the plate 26 so that it is visible from the front side of the plate. The mounting apparatus or retaining device associated with this embodiment must mount the cord control system 10 away from any substrate a sufficient distance to clear the back side of the surge suppressor 102. In another embodiment, the plate may be bent with a central ridge to accommodate the depth of the surge suppressor so the back side of the surge suppressor and plate are coplanar.

Figure 14:
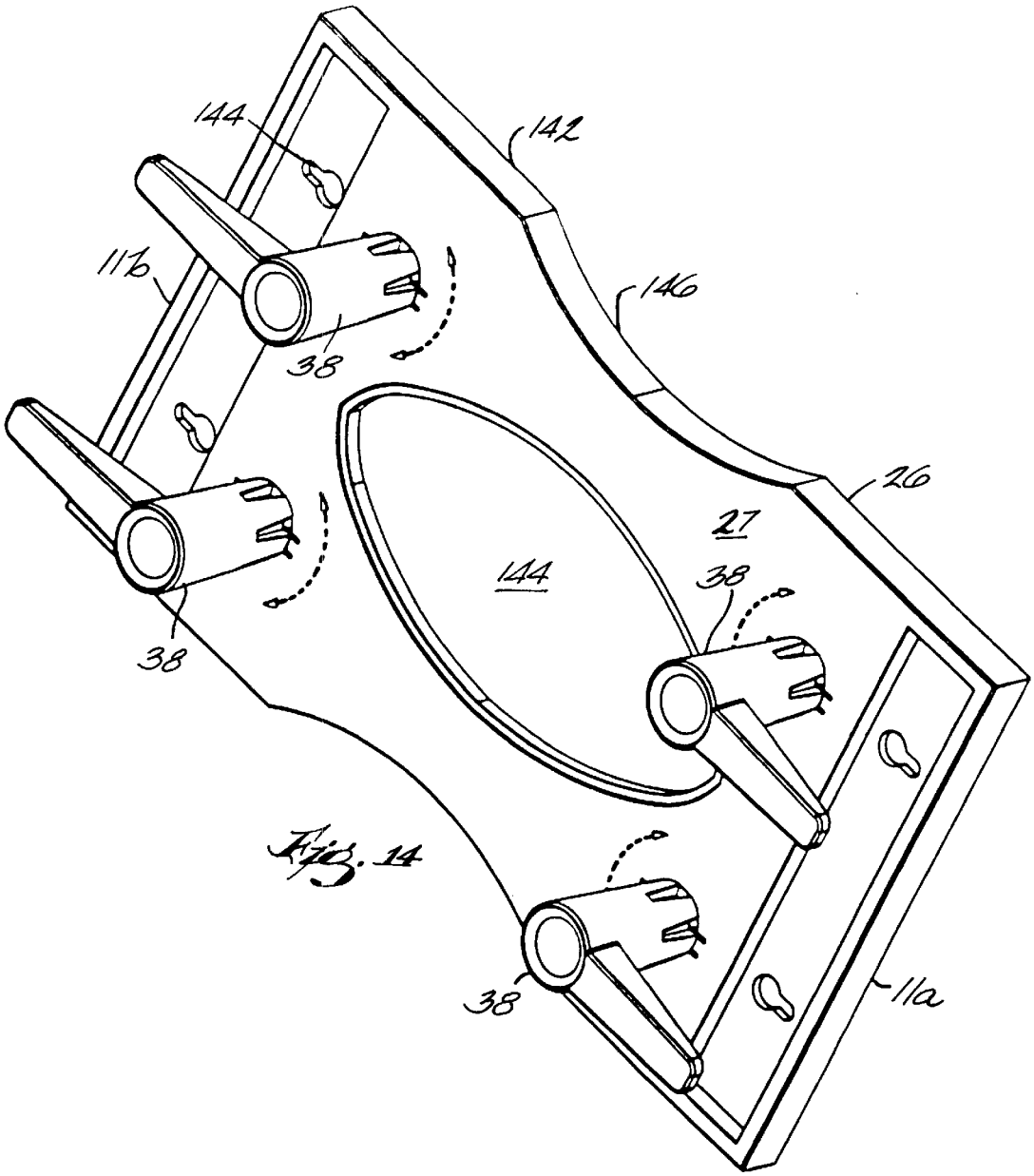
FIG. 14 is a perspective view of a sixth embodiment of the invention.
Figure 15:
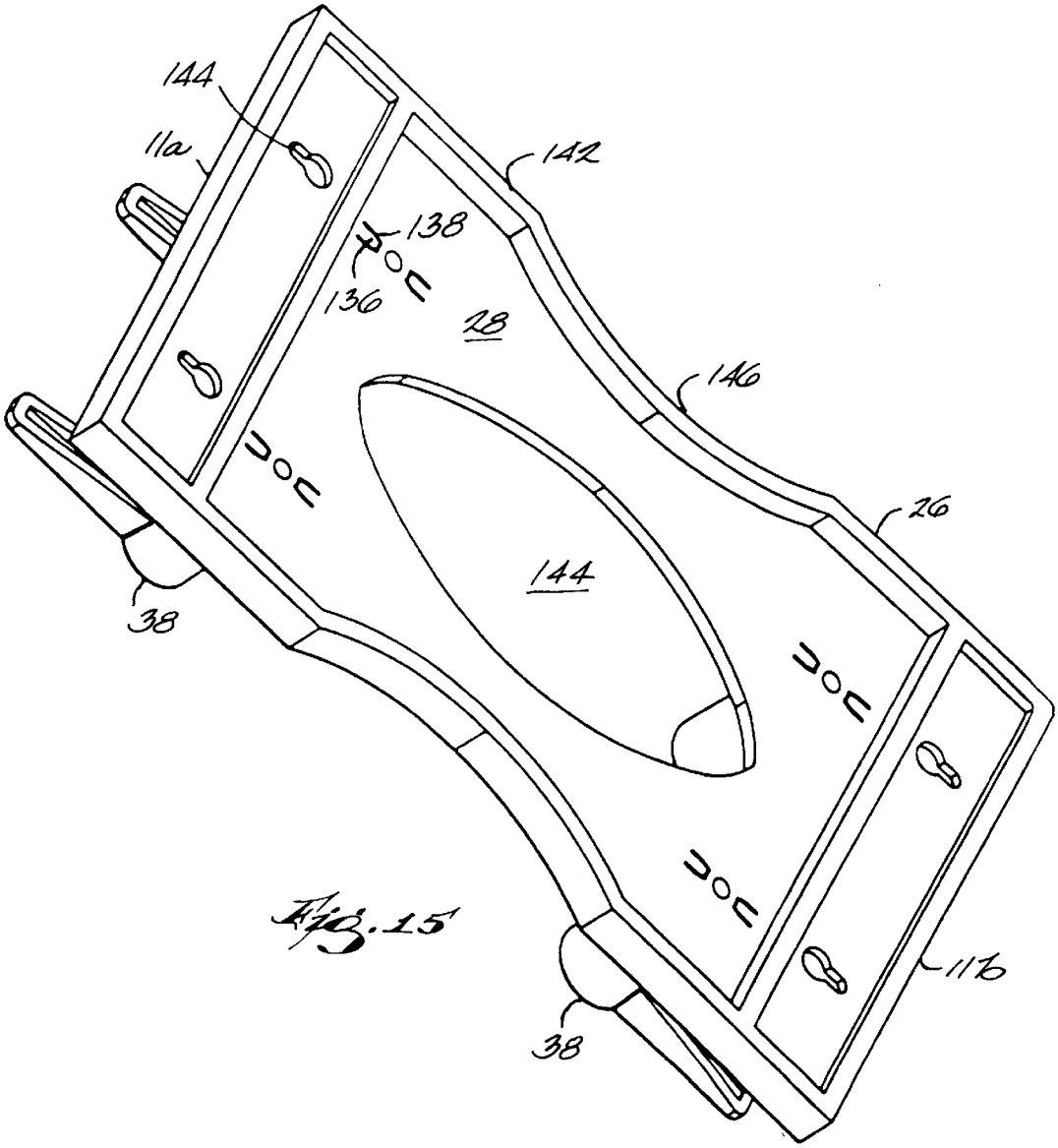
FIG. 15 is another perspective view of the sixth embodiment of the invention.
Figure 16:
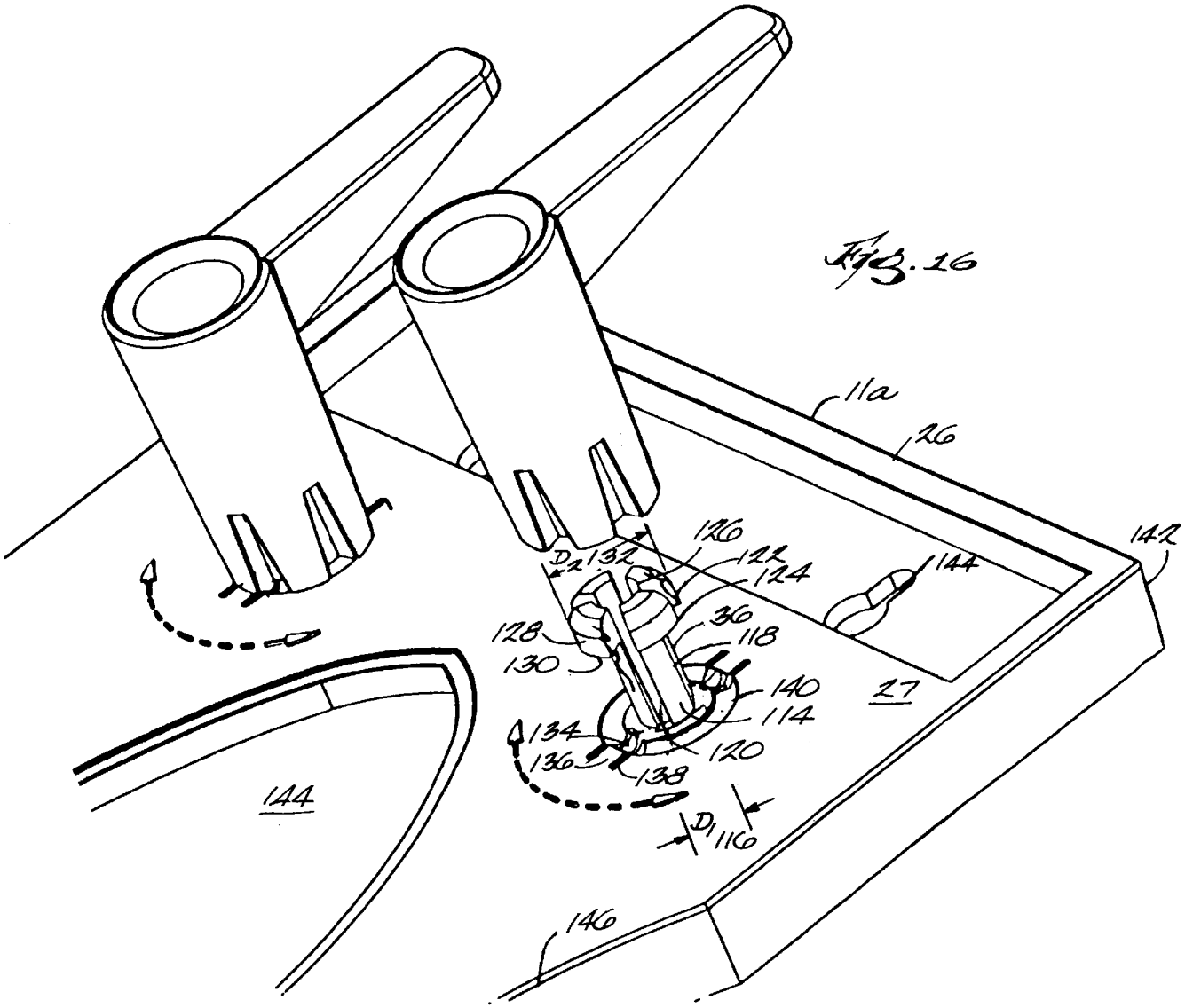
FIG. 16 is an exploded detail view of a portion of the sixth embodiment of the invention.

In a sixth embodiment, as shown in FIGS. 14–16, the plate 26 rather than being planar, can have portions of the posts 36 molded into and integral with the plate 26. The plate is preferably made of a polymer or plastic material such as glass filled nylon, high density polyethylene, or polypropylene. Other appropriate moldable materials are also contemplated. The modified plate 26 has a series of sets of molded posts adjacent the top 11*a* and bottom 11*b* edges. Each post stands upwardly from the front side 27 and perpendicular to the plane of the plate 26. Referring to FIG. 16, in a preferred embodiment, each post 36 has a base portion 114 having an outer diameter $D_1$ 116 immediately adjacent to the plate. The base portion 114 is actually made of four arms 118 arranged in a circular array. Each arm 118 is separated from the other arms by a slot 120. The relatively thin cross sections of the arms 118 allows them to bend inwardly when a hook is forced thereover and then snap back outwardly into place to capture the hook.

Extending upwardly, from the base portion, at the distal end is a locking portion 122 comprising a set of four outwardly extending arms 124 separated by slots 120 to create a hollow space between the arms 124. At the upper end of each locking portion is a tapered top section 126, a parallel side section 128 and perpendicular shoulder section 130. The outer diameter $D_2$ 132 of the side sections 128 of the locking portion is greater than the outer diameter of the base portion 116.

Each post mates with a hook 38 comprising a stem 40 and an arm 42, similar to the hooks of the prior embodiments. Each hook includes a post receiving portion and, in one embodiment, an interior anti-rotation portion. The post receiving portion comprises a lower portion having a smaller bore with an inner diameter 48. As in earlier embodiments, the inner diameter approximates the outer diameter 116 of the base portion 114 of the post, so the hook 38 can rotate around the post 36. The hook 38 also has a second inner bore 52 which is slightly larger than outer diameter 132 of the locking portion of the post. When a hook 38 is urged axially over a post 36, each tapered top section 126 collapses the corresponding base portion 114 until the hook slides over the post, at which time the locking portion springs out so that the shoulder section 130 locks on the shoulder 64 of its corresponding hook.

As with other embodiments, the cord storage system may comprise a means 62 for locking the stem at a certain orientation and a means 63 for allowing rotation of the stem about the post. In one preferred embodiment, the means 62 and 63 comprise the cooperation of protrusions 50 on the bottom side or proximal end 44 of the hook member 38 with resiliently deformable dimples 134 molded into the plate 26. The dimples 134 are able to move upwardly and downwardly to allow the protrusions 50 to ride into and out of them. The dimples 134 are located on near the ends of contilevered ledges 136 that are made by cutting or molding slots 138 on three sides of the dimples 134. In a preferred embodiment, each post 36 has a pair of resilient dimples 134, one on each of opposite sides of the post. The dimples correspond with a pair of protrusions 50 on the hook to lock the hook at a predetermined orientation and allow the hook to rotate if a sufficient force is placed on the arm of the hook to rotate it and urge the dimples inwardly so the protrusion 50 escapes from its corresponding dimple 134.

In a preferred embodiment, the front side 27 of the plate 26 also has an annular groove 140 cut into it and surrounding and spaced slightly from the post. In this embodiment, the protrusion can travel in the groove while the post is being rotated.

In another embodiment, (not shown) the means for locking 62 and allowing the hook to rotate 63 may include radially extending protrusions or slots in the base 114 or locking portion side faces 128 of the posts and corresponding slots or protrusions in the complementary inner diameter 48 or 52 of the hook 38. In another embodiment, the hook comprises an inwardly extending nub in either the upper bore 52 or lower bore 48 which resiliently locks into a slot 120 when the hook is in the proper orientation.

The molded plate, in one embodiment, also has a perimeter lip 142 giving the plate enhanced rigidity. In addition, the plate may have a retaining locking device 144 to attach the system or apparatus to an electronic device or other substrate. In one embodiment, the retaining device includes a set of ear shaped apertures. The plate can be placed over headed fasteners and then slid along the substrate so the fastener slides into the small sections of the ears. Alternatively, a single twist retainer could be inserted and twisted through a differently shaped aperture. Other retaining means are contemplated such as round apertures, for screws, hook and loop type fasteners or brackets.

The plate may also have an aperture 144 cut out of the center or preferably, any area not directly between a pair of hooks 38. In addition, the side walls, or end walls of the plate may have indentions 146 cut out in order to save material, or enhance the aesthetics of the cord storage system. In one embodiment, the shape of the aperture 144 and the shape of the indention 146 are complementary. In can be appreciated that if two or more plates 26 are installed directly beside each other, the apertures 144 and pairs of indentions 146 would look very similar, enhancing the aesthetics of the system.

In a seventh embodiment, as shown in FIGS. 17, the structure of the plate is substantially independent of the hooks. The revised plate 26 has reinforcements 148 that give the plate two dimensions. In one embodiment, the plate front face 27 is separated from the plate back face 28. Near the periphery, on either end of the plate 26, are grooves 148. The grooves 148 are characterized by undercuts 150, bottom walls 157, side walls 152 and an opening width 153. In a preferred embodiment, the ends of the grooves 148 are open. The grooves may also comprise an aperture or other device associated with the bottom wall 157 for retaining the apparatus 10 on a substitute.

Figure 18:
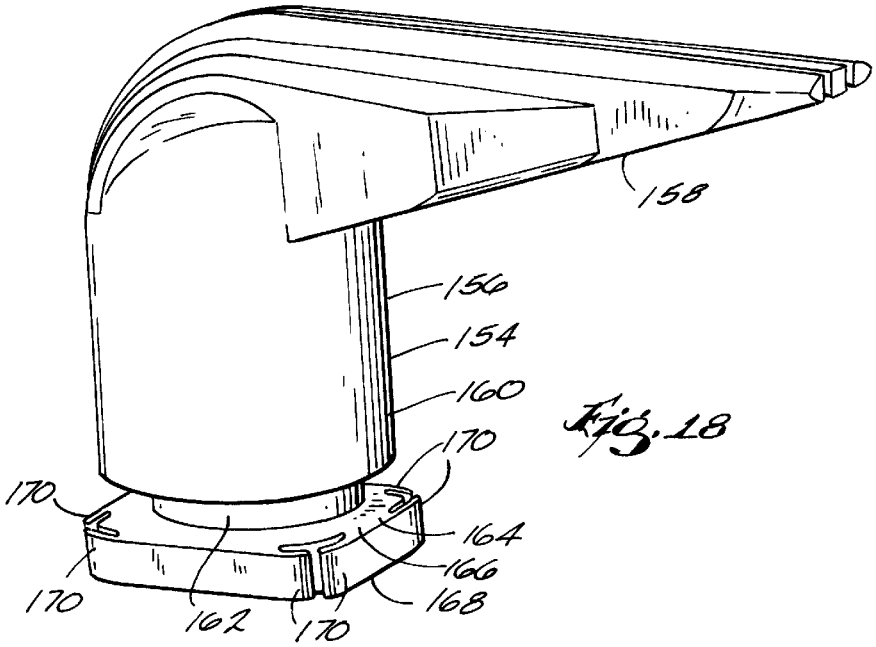
FIG. 18 is a detail of a post for use in the seventh embodiment.

Into each groove 148 is slid one of a pair of opposite hooks 154 (see FIG. 18). Unlike hooks of prior embodiments, these hooks 154 have their retaining means carried therein. Each hook has a post portion 156 and an arm portion 158. The post portion has a large diameter 160 over most of its length and a smaller diameter 162 near the bottom end. The smaller diameter 162 is slightly smaller than the width of the opening 153 groove, and when assembled, fits into the opening.

When assembled, the post retaining and location locking means 164 fits into the groove 148. The locking means 164 comprises an upper wall 166 and a lower wall 168. The upper wall 166 is in close proximity with the undercut 150 of the groove while the lower wall 168 is in close proximity with the bottom wall 151 of the groove. By this construction, the post is able to be retained in the groove while being able to rotate.

The hook 154 also comprises means 62 for locking the hook into one angular orientation and means 63 for allowing the hook to rotate. In this embodiment, the means 62 and 63 comprises fingers 170 that are positioned at each of the four corners of the locking means 164. The corners correspond with a diagonal location with respect to the centerline of the arm 158. When the hook is attempted to be rotated, the fingers are resiliently urged against the end walls 152 of the grooves 148 to resist ready rotations of the hook and maintain proper orientation.

Figure 19:
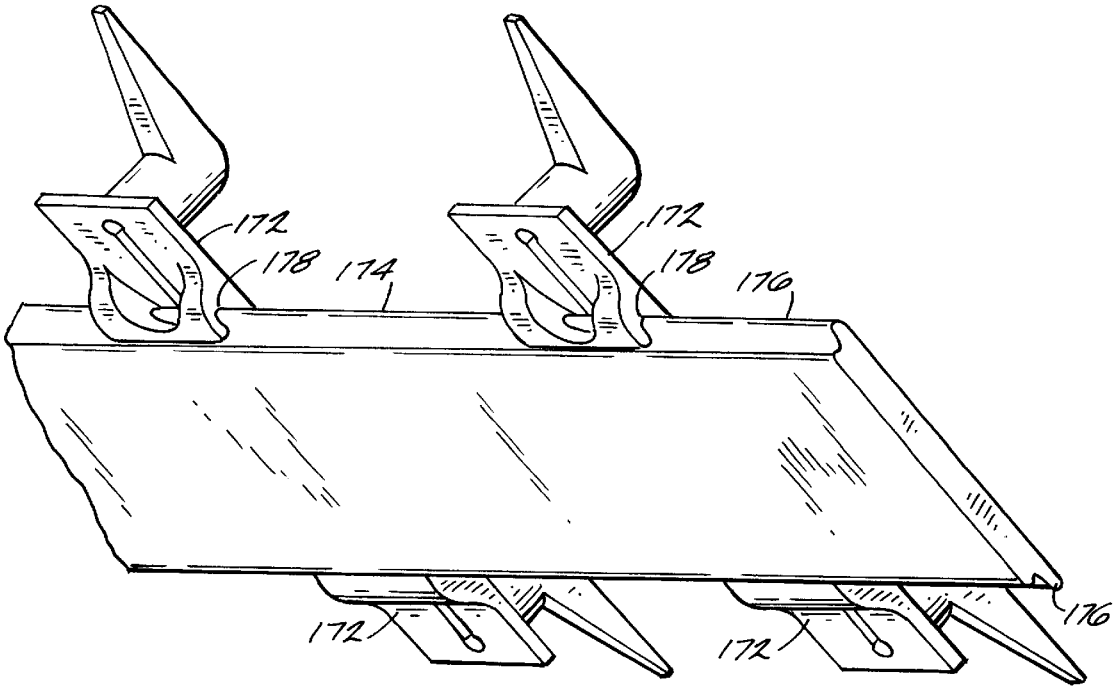
FIG. 19 is a perspective view of an eighth embodiment of the invention.

FIG. 19 shows another embodiment of the invention wherein the plate 26 is altered by substituting the mounting of the opposite pairs of hooks on moveable elongate substantially flat strips 172 that can be slid onto a central extrudable rib 174. The central rib is preferably made by extruding a plastic or aluminum material and cutting it to a desired length depending on the number of hooks and spacing between pairs of hooks as desired by the user. The peripheral edges of the rib 174 have a rounded or semicylindrical tongue shape 176 which fits into a complementary groove 178 on the bottom side near the outer ends of each of the strips 172. Near the opposite outer edges of each of the strips can be mounted a rotating hook as described above or in similar ways known in the art. By this construction, any number of pairs of hooks 38 can be easily installed in a cord control system 10. The total length of the system can be easily varied by varying the length of the extruded rib 176. Moreover, the spacing between pairs of hooks can be easily altered by placing them wherever desired on the rib. In addition, a retaining or mounting (not shown) device can be associated with either the central rib or the moveable strips.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

I claim:

1. For use in conjunction with an electronic or electrical device having input power cords and peripheral device control cords, a cord storage apparatus comprising:

a) a plate having opposed top and a bottom edges, opposed left and right edges and at least a pair of integral posts with one post adjacent the top or left side and the other post adjacent the bottom or right side of the plate, each post having a locking shoulder;

b) a retainer for attaching the plate in a stationary location near or on said electronic device; and c) at least one pair of opposed hooks, each hook associated with a post, each of said hooks including a stem having a proximal end contacting said plate, and an opposite distal end and an arm extending at a right angle to said stem at said distal end, each hook stem having an interior bore and a locking ledge cooperating with the post shoulder to allow for rotational movement of the hook while restricting the hook from having axial movement.

2. The cord storage apparatus of claim 1 wherein each of said hooks has a longitudinal center line and at least one of said pair of hooks also comprising means for locking said hook in a position in which said arm is pointed away from said other of said pair of hooks, and means for releasably allowing said arm to rotate about said stem longitudinal center line.

3. The cord storage apparatus of claim 2 wherein said means for locking said arm and said means for allowing said arm to rotate about said stem longitudinal center line comprises protrusions in the proximal end of the hook cooperating with resilient dimples formed in the plate.

4. The cord storage apparatus of claim 2 wherein said means for locking said arm and said means for allowing said arm to rotate comprises:

a) a hollow space between two upper arms of said post, and b) a nub in said bore of said hook, said nub extending into said hollow space when said hook is in the locked position and said nub urging said upper arm inwardly when said hook is allowed to rotate.

5. The cord storage apparatus of claim 2 wherein said means for locking said arm and said means for allowing said arm to rotate comprises:

a) a radially extending nub on the outer surface of said post, and b) a complementary dimple on the inner bore of said hook.

6. The cord storage apparatus of claim 2 wherein said means for locking said arm and said means for allowing said arm to rotate comprises:

a) a radially inwardly extending dimple on the outer surface of said post, and b) a complementary nub on the inner bore of said hook.

7. The cord storage apparatus of claim 1 wherein said plate has an aperture molded therein.

8. The c storage apparatus of claim 7 also having an indentation in each of said side walls.

9. An electrical cord storage apparatus comprising;

a) a plate having opposed top and bottom edges, and opposed left and right edges, b) a retaining device to locate the storage apparatus on a substrate, c) at least one pair of opposed hooks with one of the pair adjacent the top or left edge and the other adjacent the bottom or right edge respectively, each of the hooks comprising a stem having a proximal end contacting said plate and an opposite or distal end and an arm extending at a right angle to said stem at said distal end and away from the other of the pair of hooks, and d) an electrical switching device for use with at least one cord associated with said apparatus.

10. The electrical cord storage apparatus of claim 9 wherein said electrical switching device comprises a surge suppressor having a plurality of electrical outlets.

11. The electrical cord storage apparatus of claim 10 wherein the number of electrical outlets is the same as the number of pairs of opposed hooks mounted on said plate.

12. The electrical cord storage apparatus of claim 10 wherein said plate also comprises an aperture for each of the electrical outlets in the surge suppressor.

13. The electrical cord storage apparatus of claim 9 wherein said plate has a bottom portion near the bottom edge and the bottom portion is bent to form a ledge for placement of the electrical switch therein.

14. The electrical cord storage apparatus of claim 9 wherein the plate has a front side and a back side and said electrical switch is mounted on the back side and said opposed pair of hooks is mounted on said front side.

15. A cord storage apparatus comprising:

a) a plate having opposed top and bottom edges, opposed left and right edges and reinforcing ribs, b) a retaining device to locate the storage apparatus on a substrate;

c) a pair of grooves, each groove running the length of the plate, adjacent a respective top or bottom edge of the plate, d) at least one pair of opposed hooks, with one hook located in said groove adjacent said top edge and the other hook located in said groove adjacent said bottom edge.

16. The cord storage apparatus of claim 15 wherein each of said grooves comprises a bottom wall, a pair of side walls and a top wall and each of said hooks comprises a retaining portion that cooperates with said groove top, bottom and side walls.

17. A cord storage apparatus comprising:

a) a central rib, said rib having a pair of side edges each edge having a rounded shape, b) at least one hook holding strip, said strip being elongate and having a groove for mounting on said central rib, said strip also comprising a pair of outer hook mounts, c) a pair of hooks mounted on said outer hook mounts near the outer edges of said hook retaining strip, and d) an apparatus retaining device associated with one of the central rib or the hook retaining strip.

* * * * *